United States Patent [19]

Parker

[11] 4,049,051

[45] Sept. 20, 1977

[54] HEAT EXCHANGER WITH VARIABLE THERMAL RESPONSE CORE

[75] Inventor: Kenneth O. Parker, Rolling Hills Estates, Calif.

[73] Assignee: The Garrett Corporation, Los Angeles, Calif.

[21] Appl. No.: 646,828

[22] Filed: Jan. 6, 1976

Related U.S. Application Data

[62] Division of Ser. No. 490,833, July 22, 1974, abandoned.

[51] Int. Cl.[2] ..... F28F 3/02

[52] U.S. Cl. ..... 165/166

[58] Field of Search ..... 165/157, 166

[56] References Cited

U.S. PATENT DOCUMENTS

| | | | |
|---|---|---|---|
| 2,952,445 | 9/1960 | Ladd | 165/166 |
| 3,079,994 | 3/1963 | Kuehl | 165/166 |
| 3,216,495 | 11/1965 | Johnson | 165/166 |
| 3,542,124 | 11/1970 | Manfredo | 165/166 |
| 3,613,782 | 10/1971 | Mason | 165/166 |
| 3,739,843 | 6/1973 | Haberski | 165/170 |
| 3,860,065 | 1/1975 | Schauls | 165/166 |
| 3,880,232 | 4/1975 | Parker | 165/166 |

*Primary Examiner*—Carroll B. Dority, Jr.
*Assistant Examiner*—Theophil W. Streule, Jr.
*Attorney, Agent, or Firm*—Joel D. Talcott; Albert J. Miller

[57] ABSTRACT

A formed plate heat exchanger of the air and hot gas counterflow type for gas turbines with provision for thermal response zones of different heat transfer capability in the hot gas passages of the core, each succeeding zone in the gas flow direction having greater heat transfer capability than a preceding zone to reduce temperature gradients and core thermal fatigue, with elimination of core cracking and splitting.

5 Claims, 7 Drawing Figures

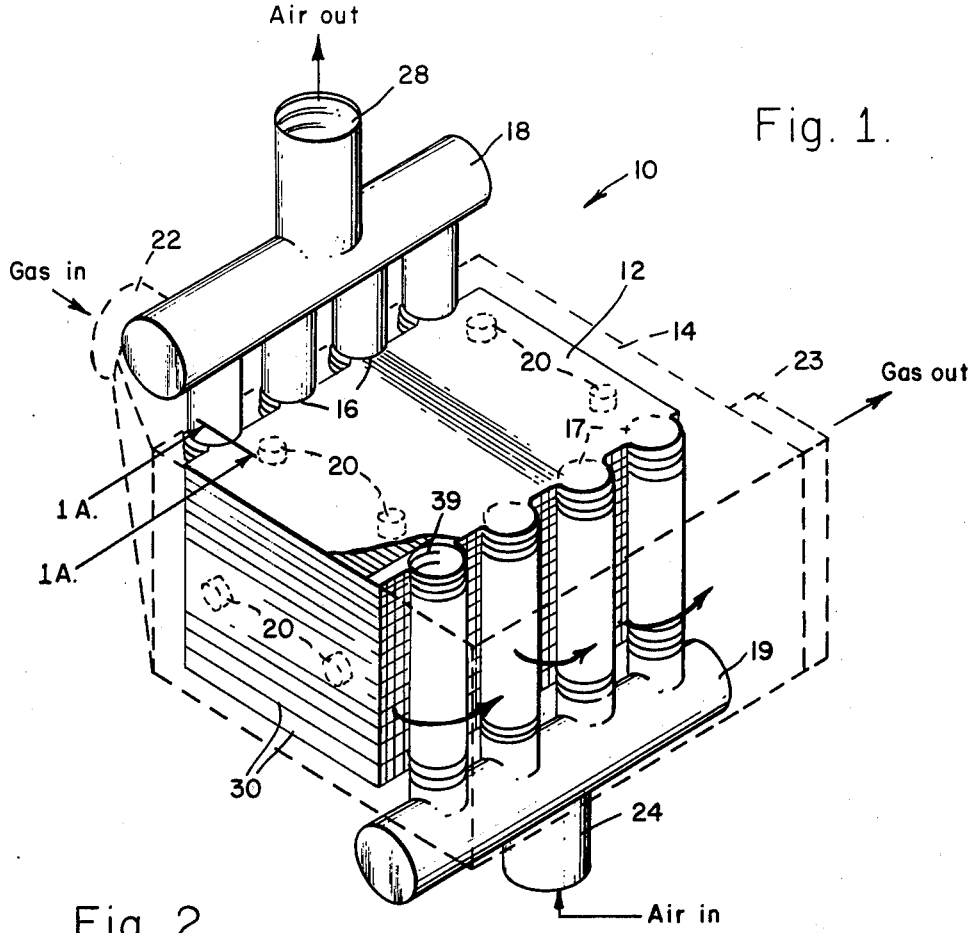
Fig. 1.
Fig. 2.
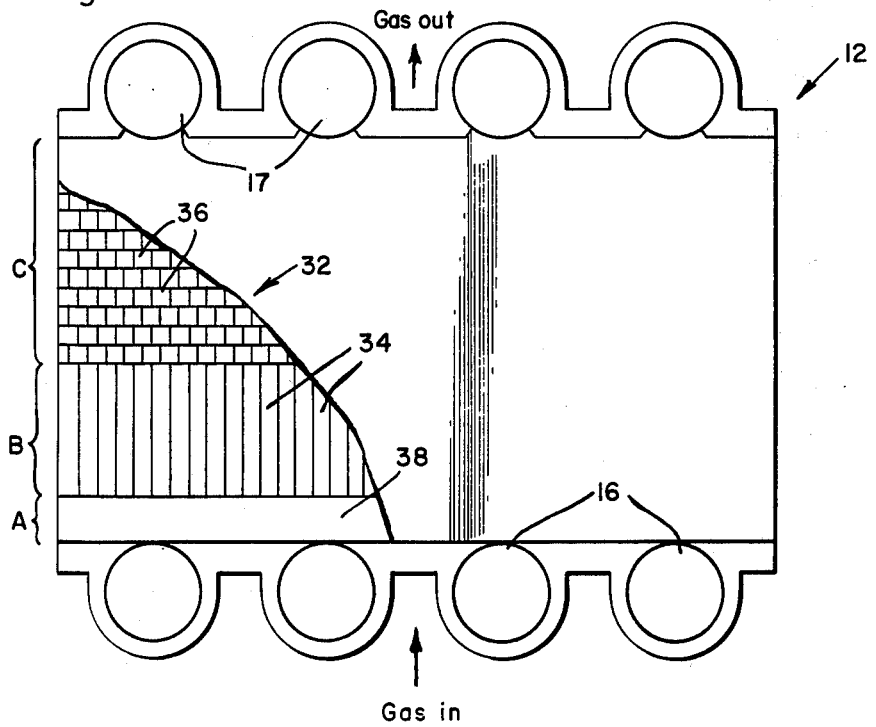

Fig. 4.
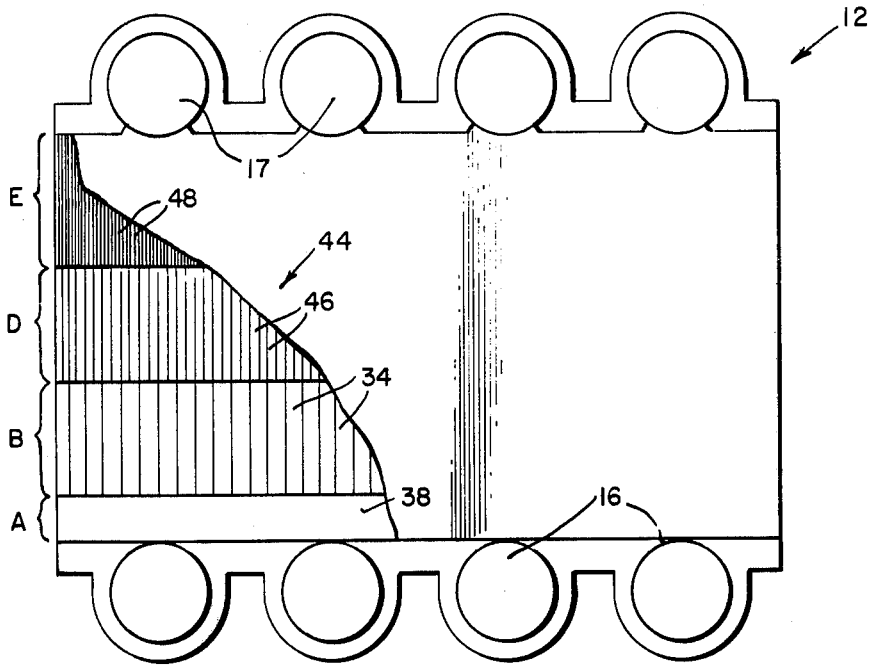
Fig. 3.
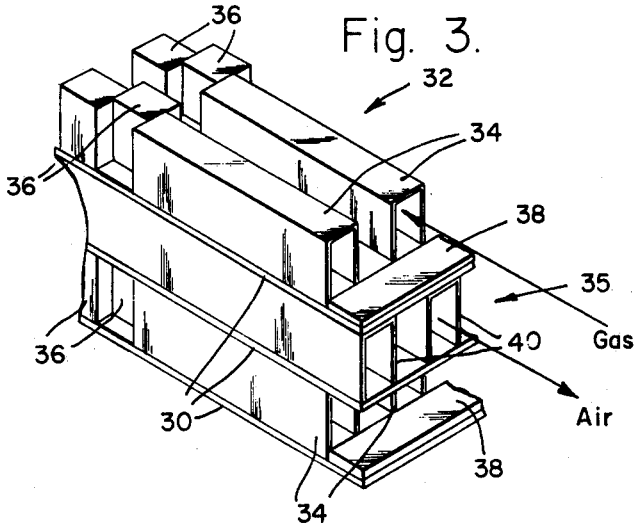
Fig. 5.
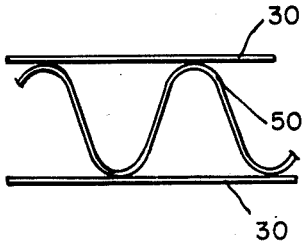
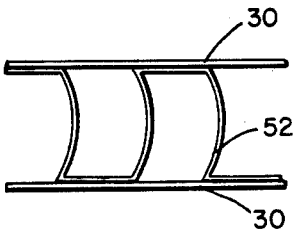
Fig. 6.

HEAT EXCHANGER WITH VARIABLE THERMAL RESPONSE CORE

This is a divisional of application Ser. No. 490,833 filed July 22, 1974 now abandoned.

BACKGROUND OF THE INVENTION

This invention relates to heat exchangers, and more particularly to heat exchanger construction with improved core thermal fatigue life.

Thermal stresses exist in localized zones of formed plate counterflow type heat exchangers for gas turbines. The highly stressed hot areas of particular concern are those located adjacent the hot face of the heat exchanger core between the air outlet manifolds, which have high thermal lag, or inertia, and the core, which has a very low thermal inertia. Because of the existence of high temperature gradients in such areas, and throughout the core, thermal fatigue cracking is apt to occur, which can cause leakage between the hot gas and air in the core passages or with the outside of the heat exchanger. Generally, thermal stresses in the core decrease in the direction of hot gas flow since the temperature gradients decrease in that direction.

An example of prior art heat exchanger construction related to thermal fatigue life is U.S. Pat. No. 3,601,185 to Rothman. Other prior art is U.S. Pat. No. 2,462,139 to Sparkes; U.S. Pat. No. 2,952,445 to Ladd; U.S. Pat. No. 3,282,011 to Meserole et al; U.S. Pat. No. 3,540,530 to Kritzer; and U.S. Pat. No. 3,542,124 to Manfredo.

SUMMARY OF THE INVENTION

Thus, a main object of this invention is to provide a heat exchanger having a core with improved thermal fatigue life to eliminate cracking and splitting.

In accordance with the present invention, there is provided means in the hot gas passages of a heat exchanger core which varies the heat transfer capability of the core in the direction of hot gas flow to reduce core temperature gradients, and thermal fatigue.

BRIEF DESCRIPTION OF THE DRAWINGS

For a more complete understanding of the invention, reference may be had to the accompanying drawings in which:

FIG. 1 is a perspective view of a heat exchanger embodying the present invention;

FIG. 2 is a plan view of the heat exchanger core of the heat exchanger of FIG. 1 showing details of one embodiment of the invention;

FIG. 3 is a partially broken away perspective view of the heat exchanger of FIG. 1;

FIG. 4 is a plan view similar to the view of FIG. 2 showing details of another embodiment of the invention;

FIG. 5 is a cross-section view of a modified fin structure in accordance with the present invention; and FIG. 6 is a cross-section view of another modified fin structure in accordance with the invention.

DETAILED DESCRIPTION OF THE PREFERRED EMBODIMENTS

Figure 1A:
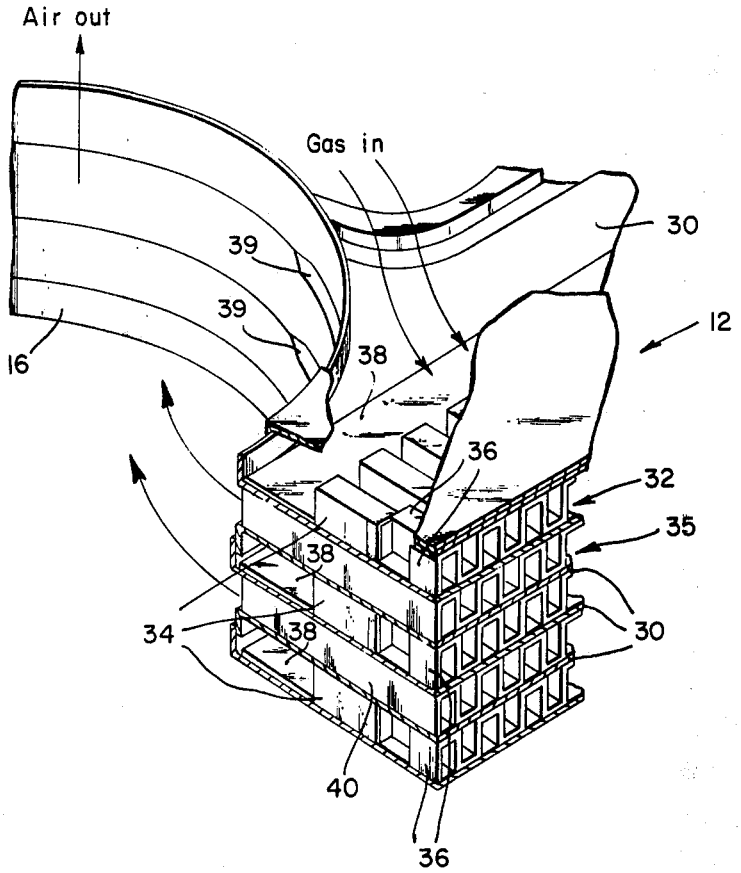
FIG. 1A is a perspective view of a portion of FIG. 1 taken in section along the lines 1A—1A.

Reference is made to FIGS. 1 & 1A wherein a heat exchanger 10 of the type embodying the present invention is illustrated. Heat exchanger 10 has a core 12 enclosed within a housing 14. The core 12 is provided with integrally fashioned air outlet and inlet manifolds 16, 17 on opposite sides of the heat exchanger connected respectively to headers 18, 19. Heat exchanger core 12 is supported within housing 14 by means of mounts 20. Housing 14 is provided with inlet and outlet passages 22 and 23 for passing hot gas through the heat exchanger core 12 in intimate heat exchange relationship with air flowing between respective manifolds 16, 17. Air enters header 19 through an inlet pipe 24. Header 18 is provided with an outlet pipe 28. Core 12 includes a plurality of formed plates 30 sandwiched together and separated from each other by gas and air passages containing layers of gas heat transfer arrangements 32 and air heat transfer arrangements 35, respectively. Strategically located openings 39 are provided the manifolds 17 for passing air between the manifolds 17 and the air passages containing the heat transfer arrangements 35. Similar openings 39 in the manifolds 16 provide for the passing of air from the air passages into the manifolds 16.

Reference is now made to FIGS. 2 and 3 wherein details of heat transfer arrangements 32 in accordance with one embodiment of the present invention are illustrated. Heat transfer arrangements 32 are each positioned in the gas passages of the core 12, and generally, consist of rows of plain fins 34 and rows of offset fins 36, with defined core thermal response zones A, B, and C. Doubler plate members 38 are provided in zones A.

Zones A are of degraded core thermal conductivity, since no heat transfer fin structure is provided therein. It will be appreciated that the zones A are in the areas of normally greatest core thermal stress due to temperature gradients, and should be wide enough to prevent splitting or cracking of the core 12. For example, zones A may have predetermined widths in the downstream gas flow direction, which could be approximately 20% of the lengths of the core gas passages.

Fins 34 are conventional, and can be of the type illustrated and described in U.S. Pat. No. 3,613,782 to Mason. Fins 34 as positioned between the plates 30 in rows spanning the heat exchanger core 12 to define the zones B.

Zones B are in core areas of normally less thermal stress and have greater thermal response than zones A because of the provision of fins 34. The heat transfer capabilities of zones B can be established to control thermal stress and cracking by predetermined selection of the type, thickness, and number of fins utilized, such as the fins 34, or the like.

Fins 36 are also conventional, and can be of the offset type illustrated and described in U.S. Pat. No. 3,542,124 to Manfredo. Fins 36 are positioned downstream in a plurality of rows, adjacent the plain fins 34, and define zones C of still greater thermal response than the zones B.

Doubler plate members 38 are fashioned from the same, or like, metallic material as the plates 30, to which they are affixed, as by brazing. Plates 38 are generally rectangular in shape, and of such widths to substantially occupy the zones A, to provide strengthening of plates 30 in these zones.

Air heat transfer arrangements 35 consist of conventional plain fins 40 positioned in the air passages to extend across the width of core 12.

In operation, air from the compressor of a gas turbine, for example, enters header 19 through air inlet pipe 24, passes upward into manifolds 17 and then into the air flow passages of core 12 provided with the air heat transfer arrangements 35. The air then flows into the manifolds 16, into header 18, and out through outlet pipe 28 to the combustion chamber of the gas turbine. At the same time hot turbine exhaust gas flows into housing 14 through inlet duct 22, into the zones A of the hot gas passages providing the least core thermal conductivity, then into the zones B containing the rows of fins 34 and providing greater core thermal conductivity than the zones A, and finally into the zones C having fins 36 which provide the most thermal response of all the zones. Finally, the gas flows out of the housing 14 through outlet duct 23.

FIG. 4 illustrates a heat transfer arrangement 44 which includes parts similar to parts utilized in the embodiment of FIG. 2 and to which like numerals are ascribed. In addition to the plain fins 34, which define the zones A, B, and doubler plate members 33, there is provided another row of plain fins 46. Fins 46 have greater fin density and are twice as many in number as the fins 34, and define thermal response zones D, which have greater heat transfer capability than zones B. Additionally provided is a row of fins 48 of even greater fin density defining the zones E. There are twice as many fins 48 as fins 46, and it will be appreciated that zones E provide greater heat transfer capability than zones D.

FIGS. 5 and 6 illustrate modified forms of fins that can be utilized in the embodiments of FIGS. 2 and 4 to further reduce core thermal fatigue. In FIG. 5, fins 50 are singly curved, at the top and bottom, rendering them resilient in the vertical direction which reduces thermal fatigue due to temperature gradients. In FIG. 6, fins 52 are provided which are doubly curved, their sides being curved in the same direction.

While specific embodiments of the invention have been illustrated and described, it is to be understood that they are provided by way of example only and that the invention is not to be construed as being limited thereto, but only by the scope of the following claims.

What I claim is:

1. In combination with a heat exchanger of the counterflow type having air outlet manifolds and hot gas passages in the core, the improvement comprising:

heat transfer means establishing core thermal response zones of different heat transfer capability for varying the thermal response of the core in the hot gas flow direction to decrease temperature gradients and reduce thermal fatigue of the core, each succeeding zone in the hot gas flow direction having greater heat transfer capability than a preceding zone, and including a zone of degraded thermal response positioned adjacent the outlet manifolds, and first, second, and third rows of plain fins of increased fin density respectively positioned in the zones succeeding the zone of degraded thermal response.

2. The combination of claim 4 wherein said fins are resilient and have sides curved in the same direction.

3. A heat exchanger of the counterflow type comprising a core including hot gas passages, air inlet manifolds, air outlet manifolds, and core thermal response zones of different heat transfer capability, each succeeding zone in the hot gas flow direction having greater heat transfer capability than a preceding zone, including a first zone adjacent the outlet manifolds of degraded thermal response having a plate member positioned in each of the hot gas passages to strengthen the core, a second zone positioned downstream in each of the hot gas passages adjacent the first zone comprising a row of plain heat conducting fins, a third zone positioned downstream in each of the hot gas passages adjacent the second zone comprising a row of plain heat conducting fins of greater fin density and greater in number than the fins in the second zone.

4. A heat exchanger as in claim 3 including a fourth zone positioned downstream in each of the hot gas passages adjacent the third zone comprising a row of plain heat conducting fins of a fin density greater in number than the fins of the third zone.

5. A heat exchanger as in claim 4 wherein the plain heat conducting fins of the second, third and fourth zones have resilient curved sides for yielding in response to thermally generated mechanical stresses.

* * * * *